US009200786B2

(12) United States Patent
Moon et al.

(10) Patent No.: US 9,200,786 B2
(45) Date of Patent: Dec. 1, 2015

(54) WIDE-ANGLE LED LAMP WITH OBLIQUELY-PLACED LED BOARDS AND MANUFACTURING PROCESS THEREOF

(71) Applicants: Daisung Moon, Seoul (KR); Sangpil Moon, Seoul (KR)

(72) Inventors: Daisung Moon, Seoul (KR); Sangpil Moon, Seoul (KR)

( * ) Notice: Subject to any disclaimer, the term of this patent is extended or adjusted under 35 U.S.C. 154(b) by 60 days.

(21) Appl. No.: 14/255,989

(22) Filed: Apr. 18, 2014

(65) Prior Publication Data

US 2015/0211719 A1 Jul. 30, 2015

Related U.S. Application Data

(63) Continuation-in-part of application No. PCT/CN2014/071431, filed on Jan. 25, 2014.

(51) Int. Cl.

| | |
|---|---|
| ***F21S 4/00*** | (2006.01) |
| ***F21V 21/00*** | (2006.01) |
| ***F21V 19/00*** | (2006.01) |
| ***F21K 99/00*** | (2010.01) |

(52) U.S. Cl.

CPC ..... *F21V 19/003* (2013.01); *F21K 9/135* (2013.01); *F21K 9/1355* (2013.01); *F21K 9/90* (2013.01)

(58) Field of Classification Search

CPC ..... F21K 9/10; F21K 9/13; F21K 9/135; F21K 9/1355

USPC ..... 362/249.02

See application file for complete search history.

(56) References Cited

U.S. PATENT DOCUMENTS

2012/0218737 A1* 8/2012 Komatsu et al. ..... 362/84
2013/0194802 A1* 8/2013 Kim et al. ..... 362/245

* cited by examiner

*Primary Examiner* — Sean Gramling

(57) ABSTRACT

The present invention relates to a wide-angle LED lamp with obliquely-placed LED boards and manufacturing process thereof. A lamp body of the LED lamp is composed of a heat radiation cup, a cylinder step, a pyramidal frustum, an inner groove, an outer circular recess, two screw holes opened at the bottoms of two opposite facets of the pyramidal frustum, a round tube molded in both the heat radiation cup and the cylinder step, and a perforation opened in the pyramidal frustum and communicating with the round tube; an annular PCB sleeves the pyramidal frustum and contacts the cylinder step; LED boards cover the pyramidal frustum, the bottom of the LED board is inserted into the inner groove of the lamp body and the top of the LED board is covered with a fixing cover; the amp body, the stopper and the base are connected by a screw.

11 Claims, 4 Drawing Sheets

WIDE-ANGLE LED LAMP WITH OBLIQUELY-PLACED LED BOARDS AND MANUFACTURING PROCESS THEREOF

CROSS-REFERENCE TO RELATED APPLICATIONS

The present application is a Continuation-in-part application of PCT application No. PCT/CN2014/071431 filed on Jan. 25, 2014, the contents of which are hereby incorporated by reference.

FIELD OF THE INVENTION

The present invention relates to a wide-angle LED lamp with obliquely-placed LED boards and manufacturing process thereof.

BACKGROUND

Lamps are classified according to light-emitting angle of LEDs arranged on a LED board, and the LED board of a commonly-used lamp is usually horizontally placed, in this way, the light-emitting angle is between 120 degrees and 180 degrees. If a light-emitting angle above 275 degrees is desired, an optical lens or reflector panel has to be applied to the LED board, alternatively, the LED board has to be vertically placed to make the light reflected downward, however, the space above the lamp may thus be dark. Therefore, additional LED boards are needed to be installed on the vertically-placed LED board so as to solve the problems of lighting difficulty above the lamp.

SUMMARY

The present invention aims to provide a wide-angle LED lamp with obliquely-placed LED boards, in which obliquely-placed LED boards are provided, such that not only the space below the LED lamp but also the space above the LED lamp will be lightened up. The present invention also aims to provide a process of manufacturing the wide-angle LED lamp with obliquely-placed LED boards.

The technical solution of the present invention is a wide-angle LED lamp with obliquely-placed LED boards, comprising a lamp cap, a base, a stopper, a lamp body, and a lamp cover that are successively connected, the lamp cover being fastened to the lamp body, the base being sleeved with the lamp body, and the base receiving a longitudinally-arranged LED driver PCB, wherein the lamp body is composed of a heat radiation cup, a cylinder step protruding from the top of the heat radiation cup, a pyramidal frustum protruding from the cylinder step, an inner groove molded at a junction between the pyramidal frustum and the cylinder step, an outer circular recess molded at a junction between the cylinder step and an edge of the heat radiation cup, two screw holes respectively opened at the bottoms of two opposite facets of the pyramidal frustum, a round tube having a consistent diameter throughout its length and molded in both the heat radiation cup and the cylinder step, and a perforation opened in the pyramidal frustum and communicating with the round tube; an annular PCB sleeves the pyramidal frustum through an inner prism-shaped hole of the annular PCB to contact the cylinder step; a plurality of LED boards cover facets of the pyramidal frustum, the bottom of each LED board is inserted into both the inner prism-shaped hole of the annular PCB and the inner groove of the lamp body, the tops of all the LED boards are covered with a fixing cover, a screw screwed into both of a center hole of the fixing cover and a screw hole at the top of the pyramidal frustum connects the fixing cover to the pyramidal frustum, and thereby fixing the LED boards; each of two screws is screwed into the screw hole of the pyramidal frustum of the lamp body, a screw hole opened in a circular plate of the stopper and positioned right under the screw hole of the pyramidal frustum and a screw hole opened in an opening end of the base to make the lamp body and the stopper connected with the base; an end of the lamp cover is fastened into the outer circular recess of the lamp body.

Preferably, the annular PCB is composed of the inner prism-shaped hole, an outer circumference, a board body, and a solder joint arranged around an edge of the inner prism-shaped hole.

Preferably, an ear-shaped bulge protrudes radially and outwards from the board body of the annular PCB and is close to an edge of two lateral faces of the inner prism-shaped hole, a semicircular hole is opened in the ear-shaped bulge, and two portions of the ear-shaped bulge that are separated by the semicircular hole have two solder joints.

Preferably, the fixing cover is composed of a cover body having a pyramidal top portion, and the center hole opened through the center of the cover body.

Preferably, the stopper is composed of the circular plate, an annular bearing body protruding downwards from the bottom of the circular plate and having a small diameter than the circular plate, the annular bearing body being inserted in the opening end of the base, the screw hole opened in the circular plate of the stopper, a semicircular notch opened in the annular bearing body and positioned right under the screw hole opened in the circular plate, and a wire outlet hole protruding upwards from the top of the circular plate and positioned near an edge of the circular plate; the stopper is inserted into the bottom of the round tube of the heat radiation cup, the wire outlet hole is inserted into a notch of the lamp body or into the perforation opened in the pyramidal frustum, and then the stopper is supported by the base.

Preferably, after two wires at the top of the LED driver PCB have been drawn out of a wire outlet hole of the stopper and a semicircular hole, the two wires are respectively fixed to two solder joints arranged at the annular PCB, wherein the wire outlet hole of the stopper is inserted into a notch of the lamp body, the notch is radially recessed from an edge of the cylinder step of the lamp body, and the semicircular hole is opened in the annular PCB and positioned right above the notch of the lamp body.

Preferably, after two wires at the top of the LED driver PCB have been passed through a wire outlet hole of the stopper, the perforation of the pyramidal frustum, and a semicircular recess formed in an end edge of a trapezoidal board of the LED board, the two wires are connected to solder joints arranged at the top of the trapezoidal board.

Preferably, the LED board is composed of a trapezoidal board matching with each facet of the pyramidal frustum, a tenon arranged at the bottom of the trapezoidal board, a plurality of LED illuminants arranged on the trapezoidal board, and a solder joint arranged between the LED illuminants and the tenon.

Preferably, a semicircular recess is formed in an end edge of the top of the trapezoidal board, and a solder joint is arranged between the semicircular recess and the LED illuminants.

Another technical solution of the present invention is a process of manufacturing the wide-angle LED lamp with obliquely-placed LED boards according to claim 1, characterized by comprising the steps of:

(1) inserting the LED driver PCB into the base;

(2) connecting the lamp cap to the base by a threaded connection;

(3) mounting the stopper on the base, putting both the stopper and the base into the round tube of the lamp body, drawing two wires at the top of the LED driver PCB out of a wire outlet hole of the stopper and a notch of the lamp body, and screwing the screw into the screw hole opened at the bottom of the facet of the pyramidal frustum of the lamp body, the screw hole of the stopper, and the screw hole of the base to make the lamp body and the stopper fixedly connected with the base;

(4) sleeving the pyramidal frustum with the annular PCB through the inner prism-shaped hole of the annular PCB to make the annular PCB contact the cylinder step; meanwhile, drawing the two wires of the LED driver PCB out of a semicircular hole of the annular PCB;

(5) covering each facet of the pyramidal frustum of the lamp body with the LED board, inserting the bottom of the LED board into both of the inner prism-shaped hole of the annular PCB and the inner groove of the lamp body, covering the tops of all the LED boards with the fixing cover, screwing the screw into both of the center hole of the fixing cover and the screw hole at the top of the pyramidal frustum to connect the fixing cover to the pyramidal frustum, and thereby fixing the LED boards;

(6) fixing the two wires drawn out of the semicircular hole of the annular PCB to solder joints arranged at the annular PCB, and welding a solder joint of the LED board to a solder joint of the annular PCB; and (7) fastening the end of the lamp cover into the outer circular recess of the lamp body to complete assembling of the LED lamp.

Another technical solution of the present invention is a process of manufacturing the wide-angle LED lamp with obliquely-placed LED boards according to claim 1, characterized by comprising the steps of:

(1) inserting the LED driver PCB into the base;

(2) connecting the lamp cap to the base by a threaded connection;

(3) mounting the stopper on the base, putting both the stopper and the base into the round tube of the lamp body, drawing two wires at the top of the LED driver PCB out of a wire outlet hole of the stopper and the perforation of the pyramidal frustum;

(4) sleeving the pyramidal frustum with the annular PCB through the inner prism-shaped hole of the annular PCB to make the annular PCB contact the cylinder step;

(5) covering each facet of the pyramidal frustum of the lamp body with the LED board, inserting the bottom of the LED board into both of the inner prism-shaped hole of the annular PCB and the inner groove of the lamp body, covering the tops of all the LED boards with the fixing cover, screwing the screw into both of the center hole of the fixing cover and the screw hole at the top of the pyramidal frustum to connect the fixing cover to the pyramidal frustum, and thereby fixing the LED boards;

(6) making the two wires which have been drawn out of the wire outlet hole of the stopper and the perforation of the pyramidal frustum pass through a semicircular recess formed in an end edge of the top of a trapezoidal board of the LED board, fixing the two wires to solder joints arranged at a top portion of the trapezoidal board, and welding a solder joint of the LED board to a solder joint of the annular PCB; and (7) fastening the end of the lamp cover into the outer circular recess of the lamp body to complete assembling of the LED lamp.

Comparing with prior arts, the technical solutions of the present invention have the following advantages.

(1) By tilting the LED boards of the present invention, users may adjust angle of emitted-light according to the need.

(2) By tilting the LED boards of the present invention, not only the space above the LED lamp will be lightened up, but also the space below the LED lamp will be lightened up to reach a standard brightness for a LED lamp.

LIST OF REFERENCE NUMERALS OF MAIN COMPONENTS

Figure 1:
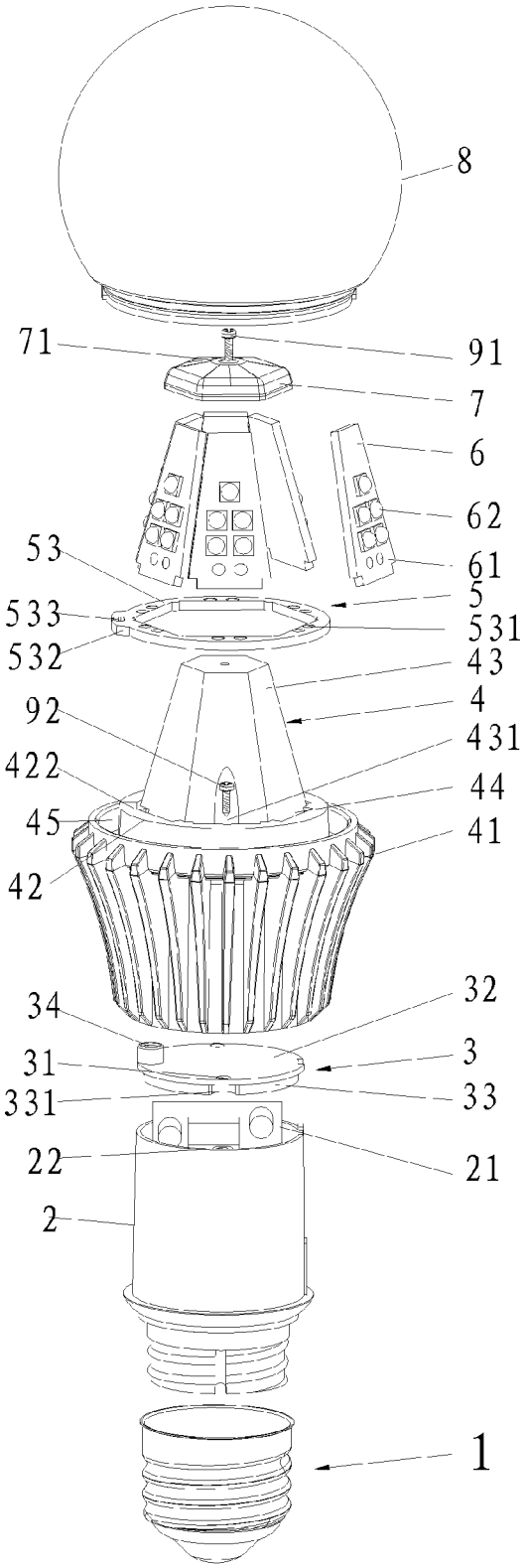
FIG. 1 is an exploded view of a wide-angle LED lamp of the present invention.

1 lamp cap
2 base
21 LED driver PCB
22 screw hole
3 stopper
31 screw hole
32 circular plate
33 annular bearing body
331 semicircular notch
34 wire outlet hole
4 lamp body
41 heat radiation cup
42 cylinder step
421 round tube
422 notch
43 pyramidal frustum
431 screw hole
432 conical-frustum-shaped hole
433 screw hole
434 perforation
44 inner groove
45 outer circular recess
5 annular PCB
51 inner prism-shaped hole
52 outer circumference
53 board body
531 solder joint
532 ear-shaped bulge
533 semicircular hole
534 solder joint
535 solder joint
536 solder joint
537 solder joint
6 LED board
61 solder joint
62 LED illuminant
63 semicircular recess
7 fixing cover

71 center hole
8 lamp cover
91 screw
92 screw
93 wire

DETAILED DESCRIPTION

Various preferred embodiments will now be described with reference to the figures.

FIG. 1 to FIG. 4 show a first embodiment of a wide-angle LED lamp of the present invention.

Figure 2:
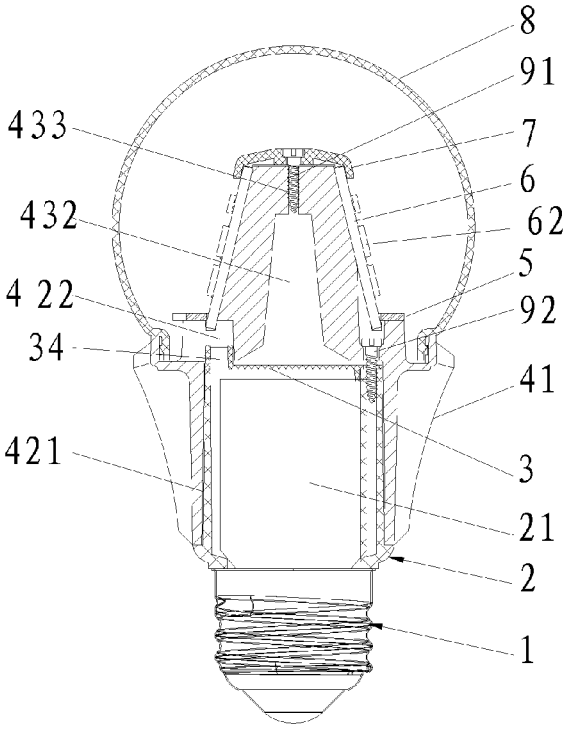
FIG. 2 is a sectional view of an assembled wide-angle LED lamp of the present invention.
Figure 3:
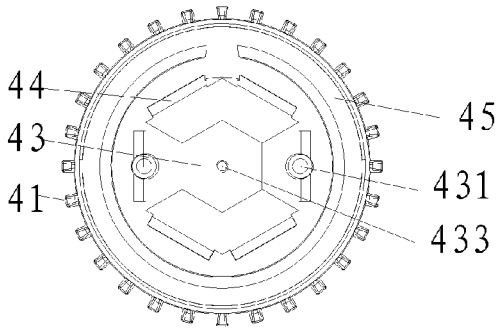
FIG. 3 is a top plan view of a lamp body of a wide-angle LED lamp of the present invention.

As shown in FIGS. 1, 2 and 3, the wide-angle LED lamp with obliquely-placed LED boards comprises a lamp cap 1, a base 2, a stopper 3, a lamp body 4, and a lamp cover 8 that are successively connected, the base 2 being sleeved with the lamp body 4, and the base 2 receiving a longitudinally-arranged LED driver PCB 21. The lamp body 4 is composed of a heat radiation cup 41, a cylinder step 42 protruding from the top of the heat radiation cup 41, a pyramidal frustum 43 protruding from the cylinder step 42, an inner groove 44 molded at a junction between the pyramidal frustum 43 and the cylinder step 42, an outer circular recess 45 molded at a junction between the cylinder step 42 and an edge of the heat radiation cup 41, two screw holes 431 respectively opened at the bottoms of two opposite facets of the pyramidal frustum 43, a round tube 421 having a consistent diameter throughout its length and molded in both the heat radiation cup 41 and the cylinder step 42, and an upper screw hole 433 and a lower conical-frustum-shaped hole 432 both opened in the pyramidal frustum 43 and communicating with the round tube 421.

Figure 4:
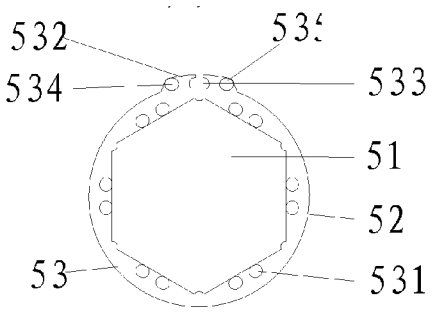
FIG. 4 is a schematic view of an annular PCB of a wide-angle LED lamp of the present invention.

As shown in FIGS. 1 and 4, an annular PCB 5 is composed of an inner prism-shaped hole 51, an outer circumference 52, a board body 53, a solder joint 531 arranged around an edge of the inner prism-shaped hole, an ear-shaped bulge 532 protruding radially and outwards from the board body 53 and being close to an edge of two lateral faces of the inner prism-shaped hole 51, a semicircular hole 533 opened in the ear-shaped bulge 532, and two solder joints 534, 535 arranged on two portions of the ear-shaped bulge 532 that are separated by the semicircular hole 533.

In the embodiment, the annular PCB 5 sleeves the pyramidal frustum 43 through the inner prism-shaped hole 51 of the annular PCB 5 to contact the cylinder step 42; a plurality of LED boards 6 cover facets of the pyramidal frustum 43, the bottom of each LED board is inserted into both the inner prism-shaped hole 51 of the annular PCB 5 and the inner groove 44 of the lamp body 4, the tops of all the LED boards are covered with a fixing cover 7, a screw 91 screwed into both of a center hole 71 of the fixing cover 7 and a screw hole 433 at the top of the pyramidal frustum 43 connects the fixing cover 7 to the pyramidal frustum 43, and thereby fixing the LED boards 6, each LED board 6 has a plurality of LED illuminants 62 thereon; each of two screws 92 is screwed into the screw hole 431 of the pyramidal frustum of the lamp body, a screw hole 31 opened in a circular plate of the stopper 3 and positioned right under the screw hole 431 of the pyramidal frustum and a screw hole 22 opened in an opening end of the base 2 to make the lamp body 4 and the stopper 3 connected with the base 2; an end of the lamp cover 8 is fastened into the outer circular recess 45 of the lamp body.

In the embodiment, the fixing cover 7 is composed of a cover body having a pyramidal top portion, and the center hole 71 opened through the center of the cover body.

In the embodiment, the stopper 3 is composed of the circular plate 32, an annular bearing body 33 protruding downwards from the bottom of the circular plate 32 and having a small diameter than the circular plate 32 with the annular bearing body 33 being inserted in the opening end of the base 2, the screw hole 31 opened in the circular plate 32, a semicircular notch 331 opened in the annular bearing body 33 and positioned right under the screw hole 31 opened in the circular plate, and a wire outlet hole 34 protruding upwards from the top of the circular plate 32 and positioned near an edge of the circular plate 32. The stopper 3 is inserted into the bottom of the round tube 421 of the heat radiation cup, the wire outlet hole 34 is inserted into a notch 422 of the lamp body, and then the stopper 3 is supported by the base 2.

In the embodiment, after two wires (not shown in the figures) at the top of the LED driver PCB 21 have been drawn out of the wire outlet hole 34 of the stopper 3 and the semicircular hole 533, the two wires are respectively fixed to the two solder joints 534, 535 arranged on the annular PCB 5, wherein the wire outlet hole 34 of the stopper 3 is inserted into the notch 422 of the lamp body, the notch 422 is radially recessed from an edge of the cylinder step of the lamp body, and the semicircular hole 533 is opened in the annular PCB 5 and positioned right above the notch 422 of the lamp body.

As shown in FIGS. 1 to 4, a process of manufacturing the wide-angle LED lamp with obliquely-placed LED boards comprises the steps of:

(1) inserting the LED driver PCB 21 into the base 2;

(2) connecting the lamp cap 1 to the base 2 by a threaded connection;

(3) mounting the stopper 3 on the base 2, putting both the stopper 3 and the base 2 into the round tube 421 of the lamp body, drawing two wires at the top of the LED driver PCB 21 out of the wire outlet hole 34 of the stopper 3 and the notch 422 of the lamp body 4, and screwing the screw 92 into the screw hole 431 opened at the bottom of the facet of the pyramidal frustum of the lamp body, the screw hole 31 of the stopper, and the screw hole 22 of the base to make the lamp body 4 and the stopper 3 fixedly connected with the base 2;

(4) sleeving the pyramidal frustum 43 with the annular PCB 5 through the inner prism-shaped hole 51 of the annular PCB 5 to make the annular PCB 5 contact the cylinder step 42; meanwhile, drawing the two wires of the LED driver PCB 21 out of the semicircular hole 533 of the annular PCB;

(5) covering each facet of the pyramidal frustum 43 of the lamp body with the LED board 6, inserting the bottom of the LED board 6 into both of the inner prism-shaped hole 51 of the annular PCB and the inner groove 44 of the lamp body, covering the tops of all the LED boards 6 with the fixing cover 7, screwing the screw 91 into both of the center hole 71 of the fixing cover and the screw hole 433 at the top of the pyramidal frustum 43 to connect the fixing cover 7 to the pyramidal frustum 43, and thereby fixing the LED boards 6;

(6) fixing the two wires drawn out of the semicircular hole 533 of the annular PCB to the solder joints 534, 535 arranged at the annular PCB 5, and welding a solder joint 61 of the LED board 6 to the solder joint 531 of the annular PCB 5; and (7) fastening the end of the lamp cover 8 into the outer circular recess 45 of the lamp body to complete assembling of the LED lamp.

FIG. 5 to FIG. 8 show a second embodiment of a wide-angle LED lamp of the present invention.

Figure 5:
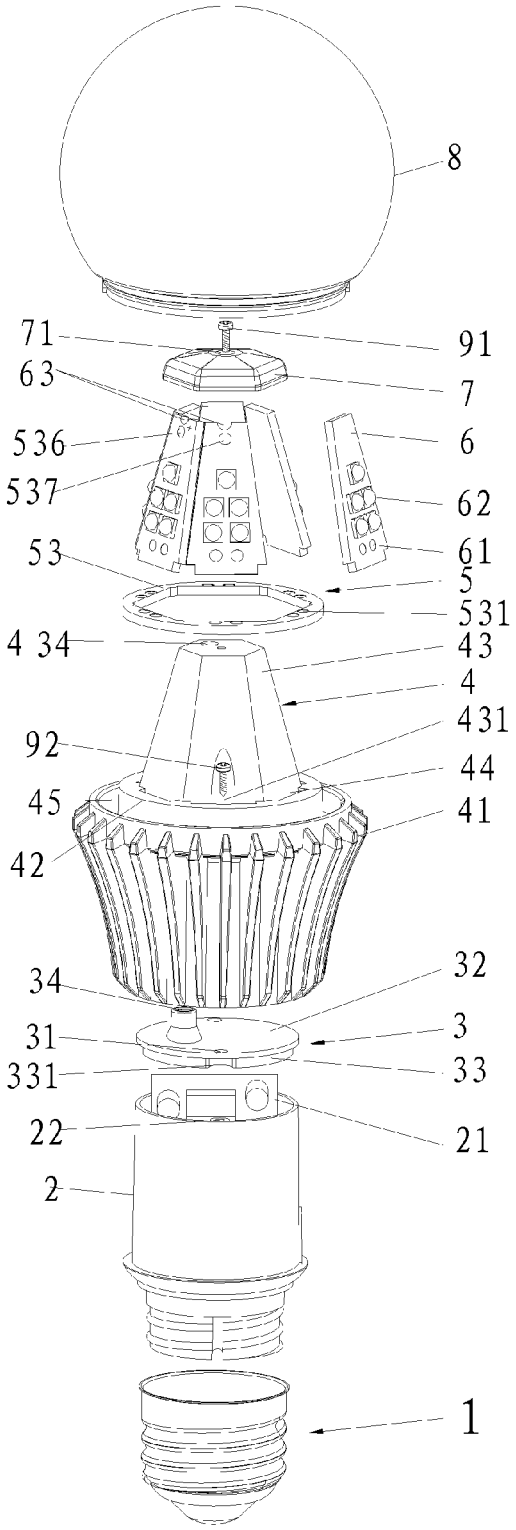
FIG. 5 is an exploded view of a wide-angle LED lamp of the present invention.
Figure 6:
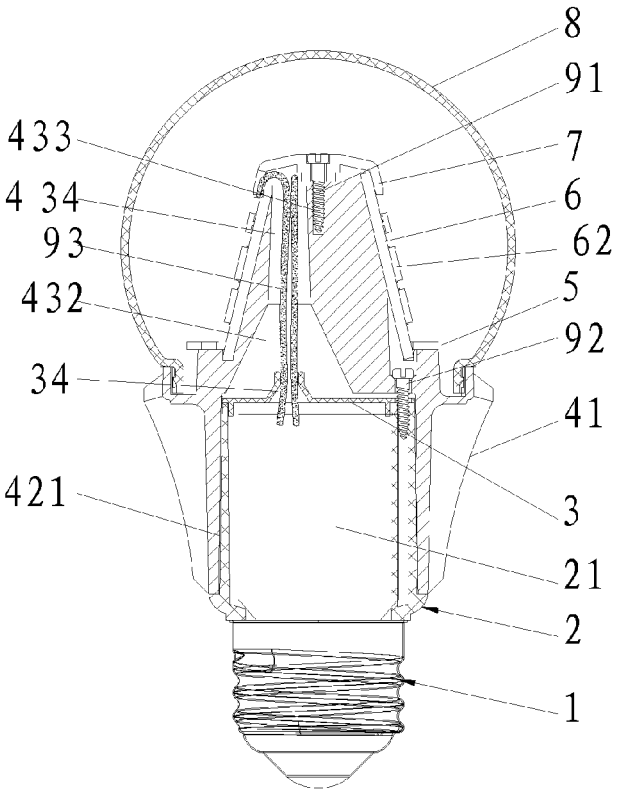
FIG. 6 is a sectional view of an assembled wide-angle LED lamp of the present invention.
Figure 7:
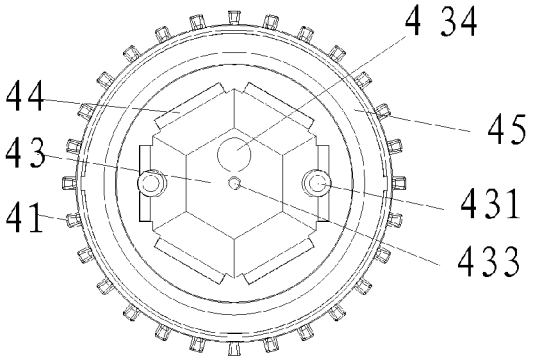
FIG. 7 is a top plan view of a lamp body of a wide-angle LED lamp of the present invention.

As shown in FIGS. 5, 6 and 7, the wide-angle LED lamp with obliquely-placed LED boards comprises a lamp cap 1, a base 2, a stopper 3, a lamp body 4, and a lamp cover 8 that are successively connected, the base 2 being sleeved with the lamp body 4, and the base 2 receiving a longitudinally-arranged LED driver PCB 21. The lamp body 4 is composed of a heat radiation cup 41, a cylinder step 42 protruding from the top of the heat radiation cup 41, a pyramidal frustum 43 protruding from the cylinder step 42, an inner groove 44 molded at a junction between the pyramidal frustum 43 and the cylinder step 42, an outer circular recess 45 molded at a junction between the cylinder step 42 and an edge of the heat radiation cup 41, two screw holes 431 respectively opened at the bottoms of two opposite facets of the pyramidal frustum 43, a round tube 421 having a consistent diameter throughout its length and molded in both the heat radiation cup 41 and the cylinder step 42, and a perforation 434 opened in the pyramidal frustum 43 and communicating with the round tube 421.

Figure 8:
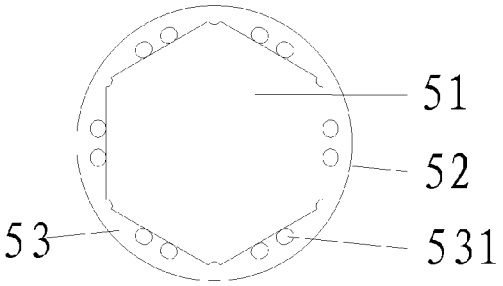
FIG. 8 is a schematic view of an annular PCB of a wide-angle LED lamp of the present invention.

As shown in FIGS. 8 and 5, an annular PCB 5 is composed of an inner prism-shaped hole 51, an outer circumference 52, a board body 53, and a solder joint 531 arranged around an edge of the inner prism-shaped hole 51.

In the embodiment, the annular PCB 5 sleeves the pyramidal frustum 43 through the inner prism-shaped hole 51 of the annular PCB 5 to contact the cylinder step 42; a plurality of LED boards 6 cover facets of the pyramidal frustum 43, the bottom of each LED board is inserted into both the inner prism-shaped hole 51 of the annular PCB 5 and the inner groove 44 of the lamp body 4, the tops of all the LED boards are covered with a fixing cover 7, a screw 91 screwed into both of a center hole 71 of the fixing cover 7 and a screw hole 433 at the top of the pyramidal frustum 43 connects the fixing cover 7 to the pyramidal frustum 43, and thereby fixing the LED boards 6, each LED board 6 has a plurality of LED illuminants 62 thereon; each of two screws 92 is screwed into the screw hole 431 of the pyramidal frustum of the lamp body, a screw hole 31 opened in a circular plate of the stopper 3 and positioned right under the screw hole 431 of the pyramidal frustum and a screw hole 22 opened in an opening end of the base 2 to make the lamp body 4 and the stopper 3 connected with the base 2; an end of the lamp cover 8 is fastened into the outer circular recess 45 of the lamp body.

In the embodiment, the fixing cover 7 is composed of a cover body having a pyramidal top portion, and the center hole 71 opened through the center of the cover body.

In the embodiment, the stopper 3 is composed of the circular plate 32, an annular bearing body 33 protruding downwards from the bottom of the circular plate 32 and having a small diameter than the circular plate 32 with the annular bearing body 33 being inserted in the opening end of the base 2, the screw hole 31 opened in the circular plate 32, a semicircular notch 331 opened in the annular bearing body 33 and positioned right under the screw hole 31 opened in the circular plate, and a wire outlet hole 34 protruding upwards from the top of the circular plate 32 and positioned near an edge of the circular plate 32. The stopper 3 is inserted into the bottom of the round tube 421 of the heat radiation cup, the wire outlet hole 34 is inserted into the perforation 434 of the pyramidal frustum 43, and then the stopper 3 is supported by the base 2.

In the embodiment, after two wires 93 at the top of the LED driver PCB 21 have been drawn out of the wire outlet hole 34 of the stopper 3, the perforation 434 of the pyramidal frustum 43, and a semicircular recess 63 formed in an end edge of the top of a trapezoidal board of the LED board, the two wires are respectively fixed to solder joints 536, 357 arranged at a top portion of the trapezoidal board.

The semicircular recess 63 is formed in the end edge of the top of the trapezoidal board, and the solder joints 536, 357 are arranged between the semicircular recess 63 and the LED illuminants 62.

As shown in FIGS. 5 to 8, a process of manufacturing the wide-angle LED lamp with obliquely-placed LED boards comprises the following steps:

(1) inserting the LED driver PCB 21 into the base 2;

(2) connecting the lamp cap 1 to the base 2 by a threaded connection;

(3) mounting the stopper 3 on the base 2, putting both the stopper 3 and the base 2 into the round tube 421 of the lamp body, drawing the two wires 93 at the top of the LED driver PCB 21 out of the wire outlet hole 34 of the stopper and the perforation 434 of the pyramidal frustum 43;

(4) sleeving the pyramidal frustum 43 with the annular PCB 5 through the inner prism-shaped hole 51 of the annular PCB 5 to make the annular PCB 5 contact the cylinder step 42;

(5) covering each facet of the pyramidal frustum 43 of the lamp body with the LED board 6, inserting the bottom of the LED board 6 into both of the inner prism-shaped hole 51 of the annular PCB and the inner groove 44 of the lamp body, covering the tops of all the LED boards 6 with the fixing cover 7, screwing the screw 91 into both of the center hole 71 of the fixing cover 7 and the screw hole 433 at the top of the pyramidal frustum 43 to connect the fixing cover 7 to the pyramidal frustum 43, and thereby fixing the LED boards 6;

(6) making the two wires 93 which have been drawn out of the wire outlet hole 34 of the stopper and the perforation 434 of the pyramidal frustum 43 pass through the semicircular recess 63 formed in the end edge of the top of the trapezoidal board of the LED board 6, fixing the two wires to the solder joints 536, 537 arranged at the top portion of the trapezoidal board, and welding a solder joint 61 of the LED board 6 to the solder joint 531 of the annular PCB 5; and (7) fastening the end of the lamp cover 8 into the outer circular recess 45 of the lamp body to complete assembling of the LED lamp.

All the above are the preferred embodiments of the present invention, and the invention is intended to cover various modifications and equivalent arrangements included within the scope of the invention.

What is claimed is:

1. A wide-angle LED lamp with obliquely-placed LED boards, comprising a lamp cap, a base, a stopper, a lamp body, and a lamp cover that are successively connected, the lamp cover being fastened to the lamp body, the base being sleeved with the lamp body, and the base receiving a longitudinally-arranged LED driver PCB, wherein the lamp body is composed of a heat radiation cup, a cylinder step protruding from the top of the heat radiation cup, a pyramidal frustum protruding from the cylinder step, an inner groove molded at a junction between the pyramidal frustum and the cylinder step, an outer circular recess molded at a junction between the cylinder step and an edge of the heat radiation cup, two screw holes respectively opened at the bottoms of two opposite facets of the pyramidal frustum, a round tube having a consistent diameter throughout its length and molded in both the heat radiation cup and the cylinder step, and a perforation opened in the pyramidal frustum and communicating with the round tube;

an annular PCB sleeves the pyramidal frustum through an inner prism-shaped hole of the annular PCB to contact the cylinder step;

a plurality of LED boards cover facets of the pyramidal frustum, the bottom of each LED board is inserted into both the inner prism-shaped hole of the annular PCB and the inner groove of the lamp body, the tops of all the LED boards are covered with a fixing cover, a screw screwed into both of a center hole of the fixing cover and a screw hole at the top of the pyramidal frustum connects the fixing cover to the pyramidal frustum, and thereby fixing the LED boards;

each of two screws is screwed into the screw hole of the pyramidal frustum of the lamp body, a screw hole opened in a circular plate of the stopper and positioned right under the screw hole of the pyramidal frustum and a screw hole opened in an opening end of the base to make the lamp body and the stopper connected with the base;

an end of the lamp cover is fastened into the outer circular recess of the lamp body.

2. The wide-angle LED lamp with obliquely-placed LED boards according to claim 1, wherein the annular PCB is composed of the inner prism-shaped hole, an outer circumference, a board body, and a solder joint arranged around an edge of the inner prism-shaped hole.

3. The wide-angle LED lamp with obliquely-placed LED boards according to claim 2, wherein an ear-shaped bulge protrudes radially and outwards from the board body of the annular PCB and is close to an edge of two lateral faces of the inner prism-shaped hole, a semicircular hole is opened in the ear-shaped bulge, and two portions of the ear-shaped bulge that are separated by the semicircular hole have two solder joints.

4. The wide-angle LED lamp with obliquely-placed LED boards according to claim 1, wherein the fixing cover is composed of a cover body having a pyramidal top portion, and the center hole opened through the center of the cover body.

5. The wide-angle LED lamp with obliquely-placed LED boards according to claim 1, wherein the stopper is composed of the circular plate, an annular bearing body protruding downwards from the bottom of the circular plate and having a small diameter than the circular plate, the annular bearing body being inserted in the opening end of the base, the screw hole opened in the circular plate of the stopper, a semicircular notch opened in the annular bearing body and positioned right under the screw hole opened in the circular plate, and a wire outlet hole protruding upwards from the top of the circular plate and positioned near an edge of the circular plate;

the stopper is inserted into the bottom of the round tube of the heat radiation cup, the wire outlet hole is inserted into a notch of the lamp body or into the perforation opened in the pyramidal frustum, and then the stopper is supported by the base.

6. The wide-angle LED lamp with obliquely-placed LED boards according to claim 1, wherein after two wires at the top of the LED driver PCB have been drawn out of a wire outlet hole of the stopper and a semicircular hole, the two wires are respectively fixed to two solder joints arranged at the annular PCB, wherein the wire outlet hole of the stopper is inserted into a notch of the lamp body, the notch is radially recessed from an edge of the cylinder step of the lamp body, and the semicircular hole is opened in the annular PCB and positioned right above the notch of the lamp body.

7. The wide-angle LED lamp with obliquely-placed LED boards according to claim 1, wherein after two wires at the top of the LED driver PCB have been passed through a wire outlet hole of the stopper, the perforation of the pyramidal frustum, and a semicircular recess formed in an end edge of a trapezoidal board of the LED board, the two wires are connected to solder joints arranged at the top of the trapezoidal board.

8. The wide-angle LED lamp with obliquely-placed LED boards according to claim 1, wherein the LED board is composed of a trapezoidal board matching with each facet of the pyramidal frustum, a tenon arranged at the bottom of the trapezoidal board, a plurality of LED illuminants arranged on the trapezoidal board, and a solder joint arranged between the LED illuminants and the tenon.

9. The wide-angle LED lamp with obliquely-placed LED boards according to claim 8, wherein a semicircular recess is formed in an end edge of the top of the trapezoidal board, and a solder joint is arranged between the semicircular recess and the LED illuminants.

10. A process of manufacturing the wide-angle LED lamp with obliquely-placed LED boards according to claim 1, characterized by comprising the steps of:

(1) inserting the LED driver PCB into the base;

(2) connecting the lamp cap to the base by a threaded connection;

(3) mounting the stopper on the base, putting both the stopper and the base into the round tube of the lamp body, drawing two wires at the top of the LED driver PCB out of a wire outlet hole of the stopper and a notch of the lamp body, and screwing the screw into the screw hole opened at the bottom of the facet of the pyramidal frustum of the lamp body, the screw hole of the stopper, and the screw hole of the base to make the lamp body and the stopper fixedly connected with the base;

(4) sleeving the pyramidal frustum with the annular PCB through the inner prism-shaped hole of the annular PCB to make the annular PCB contact the cylinder step; meanwhile, drawing the two wires of the LED driver PCB out of a semicircular hole of the annular PCB;

(5) covering each facet of the pyramidal frustum of the lamp body with the LED board, inserting the bottom of the LED board into both of the inner prism-shaped hole of the annular PCB and the inner groove of the lamp body, covering the tops of all the LED boards with the fixing cover, screwing the screw into both of the center hole of the fixing cover and the screw hole at the top of the pyramidal frustum to connect the fixing cover to the pyramidal frustum, and thereby fixing the LED boards;

(6) fixing the two wires drawn out of the semicircular hole of the annular PCB to solder joints arranged at the annular PCB, and welding a solder joint of the LED board to a solder joint of the annular PCB; and (7) fastening the end of the lamp cover into the outer circular recess of the lamp body to complete assembling of the LED lamp.

11. A process of manufacturing the wide-angle LED lamp with obliquely-placed LED boards according to claim 1, characterized by comprising the steps of:

(1) inserting the LED driver PCB into the base;

(2) connecting the lamp cap to the base by a threaded connection;

(3) mounting the stopper on the base, putting both the stopper and the base into the round tube of the lamp body, drawing two wires at the top of the LED driver PCB out of a wire outlet hole of the stopper and the perforation of the pyramidal frustum;

(4) sleeving the pyramidal frustum with the annular PCB through the inner prism-shaped hole of the annular PCB to make the annular PCB contact the cylinder step;

(5) covering each facet of the pyramidal frustum of the lamp body with the LED board, inserting the bottom of the LED board into both of the inner prism-shaped hole of the annular PCB and the inner groove of the lamp body, covering the tops of all the LED boards with the fixing cover, screwing the screw into both of the center hole of the fixing cover and the screw hole at the top of the pyramidal frustum to connect the fixing cover to the pyramidal frustum, and thereby fixing the LED boards;

(6) making the two wires which have been drawn out of the wire outlet hole of the stopper and the perforation of the pyramidal frustum pass through a semicircular recess formed in an end edge of the top of a trapezoidal board of the LED board, fixing the two wires to solder joints arranged at a top portion of the trapezoidal board, and welding a solder joint of the LED board to a solder joint of the annular PCB; and (7) fastening the end of the lamp cover into the outer circular recess of the lamp body to complete assembling of the LED lamp.

* * * * *